US008122660B2

(12) United States Patent
Kekanovic

(10) Patent No.: US 8,122,660 B2
(45) Date of Patent: Feb. 28, 2012

(54) POSSIBILITY OF SPECIAL LIGHTENING, INSULATING AND REINFORCING INTERMEDIATE FLOOR CONSTRUCTIONS

(76) Inventor: Milan Kekanovic, Subotica (RS)

( * ) Notice: Subject to any disclaimer, the term of this patent is extended or adjusted under 35 U.S.C. 154(b) by 444 days.

(21) Appl. No.: 12/093,595

(22) PCT Filed: Nov. 15, 2006

(86) PCT No.: PCT/YU2006/000029

§ 371 (c)(1),
(2), (4) Date: May 14, 2008

(87) PCT Pub. No.: WO2007/059538

PCT Pub. Date: May 24, 2007

(65) Prior Publication Data

US 2010/0037545 A1 Feb. 18, 2010

(30) Foreign Application Priority Data

Nov. 15, 2005 (RS) ..... P-855/05

(51) Int. Cl.
*E04C 5/20* (2006.01)
*E04C 5/00* (2006.01)

(52) U.S. Cl. ..... 52/309.17; 52/309.4; 52/309.14; 52/448; 52/677; 52/688

(58) Field of Classification Search ..... 52/319, 52/320, 321, 322, 323, 332, 338, 340, 341, 52/421, 422, 423, 448, 309.1, 309.4, 309.6, 52/309.7, 309.8, 309.9, 309.12, 309.13, 309.14, 52/309.15, 309.16, 309.17, 677, 678, 687, 52/689

See application file for complete search history.

(56) References Cited

U.S. PATENT DOCUMENTS 1,406,379 A * 2/1922 Hatch ..... 52/687
1,911,957 A * 5/1933 Kassmir ..... 52/687
(Continued)

FOREIGN PATENT DOCUMENTS

EP 14294 A1 * 8/1980
(Continued)

OTHER PUBLICATIONS

"Degrees, Minutes, Secons" web page; All contents of Zona Land (except pictures of scientists and mathematicians) © Copyright 1997-2006, Edward A. Zobel. All rights reserved; located at http://id.mind.net/~zona/mmts/trigonometryRealms/degMinSec/degMinSec.htm.*

(Continued)

*Primary Examiner* — Brian Glessner
*Assistant Examiner* — Joseph J Sadlon

(57) ABSTRACT

The possibility of special lightening, insulating and reinforcing intermediate floor constructions enables fast building of semi-prefibraceted and prefabricated floor with complete insulation, bearing capacity and smaller price. Floor elements and are constructed to that already present steel space trusses can be placed in their channels, so that are hastened the building of intermediate floor constructions and makes them cheaper, too. They are minimum shorting at the ends and at the middle of beams, so the works below can be proceeding and the required working time is shorter. The intermediate floor construction is already insulating, so they are no need for insulating, which makes the construction cheaper and the required working time shorter. The plates are enabling the increase of the height of the floor constructions, by tying two beams in the construction. Usage of distance elements and protects the reinforcement in floor construction, so they are no need for corrosion protection.

5 Claims, 10 Drawing Sheets

U.S. PATENT DOCUMENTS

| | | | | | |
|---|---|---|---|---|---|
| 2,005,958 | A | * | 6/1935 | Sereff | 52/326 |
| 2,295,216 | A | * | 9/1942 | Joy | 52/427 |
| 2,349,399 | A | * | 5/1944 | Awbrey | 52/686 |
| 3,108,406 | A | * | 10/1963 | Ellis | 52/577 |
| 3,735,543 | A | * | 5/1973 | Simon | 52/553 |
| 4,553,875 | A | * | 11/1985 | Casey | 404/6 |
| 4,644,727 | A | * | 2/1987 | Hanson et al. | 52/687 |
| 5,421,136 | A | * | 6/1995 | Van De Peer | 52/294 |
| 5,709,060 | A | * | 1/1998 | Vaughan et al. | 52/426 |
| 6,418,686 | B1 | * | 7/2002 | Record | 52/309.15 |
| 7,037,572 | B2 | * | 5/2006 | Gleeson | 428/192 |
| 7,281,357 | B2 | * | 10/2007 | Femminella | 52/334 |

FOREIGN PATENT DOCUMENTS

| | | | | |
|---|---|---|---|---|
| EP | 987377 | A2 | * | 3/2000 |
| FR | 2540161 | A1 | * | 8/1984 |
| GB | 2103749 | A | * | 2/1983 |
| WO | WO 9509953 | A1 | * | 4/1995 |

OTHER PUBLICATIONS

"Trapezium" web page; © 2009 Copyright John Page;located at http://www.mathopenref.com/trapezium.html.*

* cited by examiner

POSSIBILITY OF SPECIAL LIGHTENING, INSULATING AND REINFORCING INTERMEDIATE FLOOR CONSTRUCTIONS

TECHNICAL FIELD

The subject of the invention, generally speaking, belongs to the field of civil engineering. According to the International classifications of patents (ICP) the subject of the invention can be market with the following classification symbols: E 04 B 5/08, E 04 C1/24 and E 04 C 5/065.

THE TECHNICAL PROBLEM

The technical problem is to be solved with the invention is: how to construct a lightweight intermediate floor construction, so it should be lightweight, bearing, thermo insulating, prefabricated and semi-prefabricated with shorts only on the middle and on the ends of it. The expanded polystyrene on the bottom of lightweight intermediate floor construction should be a formwork, a hollow tile, a filling and the thermo insulation of the construction itself.

STATE OF TECHNOLOGY/BACKGROUND ART

There are lot of prefabricated and semi-prefabricated intermediate floor constructions, with ceramic or concrete filling, which are shored on several shorts during the mounting and the concreting. There is a lightweight intermediate construction with formwork made from expanded polystyrene, but it should be shorted on every 60 or 80 centimeters. That makes the floor construction expensive and non-practical, because there are lot of strut frames, which prevents the building below them. The present pre-stressed intermediate floor constructions are much more expensive, they are not thermo insulating and they are sensitive to the corrosion of the thin steel wires inside of them.

Document FR 1602 029 introduces plate elements for intermediate floor constructions made from burned clay. Building with those elements requires shuttering of the whole construction. Plate elements introduced in PCT/YU 2006/000029 are made from polystyrene and they allow the ability of making prefabricated mounting beams. The similarity between two solutions is in the fact that both of elements have channels for reinforcement, while the reinforcement is completely different.

Document WO 95/09953 introduces elements for intermediate floor constructions, which can be used to form prefabricated mounting beams. Building with those elements requires a lot of shores. Plate elements introduced in PCT/YU 2006/000029 are enabling, because they have cross ribs. Polystyrene elements in PCT/YU 2006/000029 are supported at three points, so the system is completely safe.

Document EP 0987 377 A2 introduces elements for beams with special shaped steel lattice built in elements. Those floor constructions do not have cross rigidity. Plate elements introduced in PCT/YU 2006/000029 forms longitudinal and cross channels, which enables rigidity of the construction in both directions.

Document U.S. Pat. No. 6,817,150 introduces elements for intermediate floor constructions made from polystyrene, with formed plate elements built in it, which are enabling rigidity of the construction during mounting and concreting. Still those floor constructions do not have cross rigidity, while floor constructions made from plate elements introduced in PCT/YU 2006/000029 are rigid in both directions.

THE ESSENCE OF THE INVENTION

Expanded polystyrene in granules up to 5 mm are placed in special formed moulds, and with already known technology, the specially shaped polystyrene floor elements are produced. These floor elements are formed to be filling floor elements with channel for reinforcement. The prefabricated or semi-prefabricated beam is thermo insulating, by its bottom side, so it prevents the warm air to enter the floor construction.

After specially shaped polystyrene floor elements are produced, the already present reinforcement made as space trusses are build in channels of elements. The lower part of those channels is filled with concrete, so the semi-prefabricated floor beams are done. The beams are placed on shorts, on the ends and on the middle of them. Prefabricated beams are made with same technology, but the concreting goes up to the top of the channels. The prefabricated beams are shorted only on the ends of them The unique of this system is in building the beams with at least two space trusses, so there is no need for extra reinforcement. Double space trussing enables the use of minimum shorts, too.

In the aim to protect the reinforcement in concrete, special distance-elements are built in channels, which are enabling the distance between reinforcement and polystyrene and between reinforcement and concrete.

SHORT DESCRIPTION OF THE FIGURES

In the aim to better understanding the invention: great span intermediate floor construction with special reinforced semi-prefabricated small beams and universal filler blocks, the following figures are given:

FIG. 1-1 is a side end view of the floor element as disclosed in FIG. 1;

FIG. 1-2 is an end view of the floor element as disclosed in FIG. 1;

FIG. 1-3 is a top view of the floor element as disclosed in FIG. 1;

FIG. 2 is a floor element made from polystyrene with rectangle channel;

FIG. 2-1 is a side view of the floor element as disclosed in FIG. 2;

Figure 1:
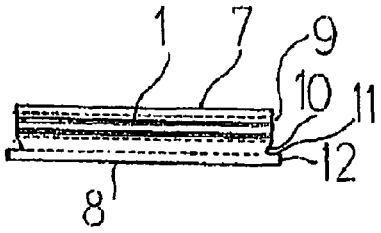
FIG. 1 is a floor element made from polystyrene with slope sides by it bottom side.
Figures 1, 2:
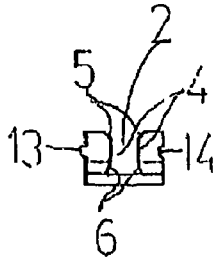
Figure 1:
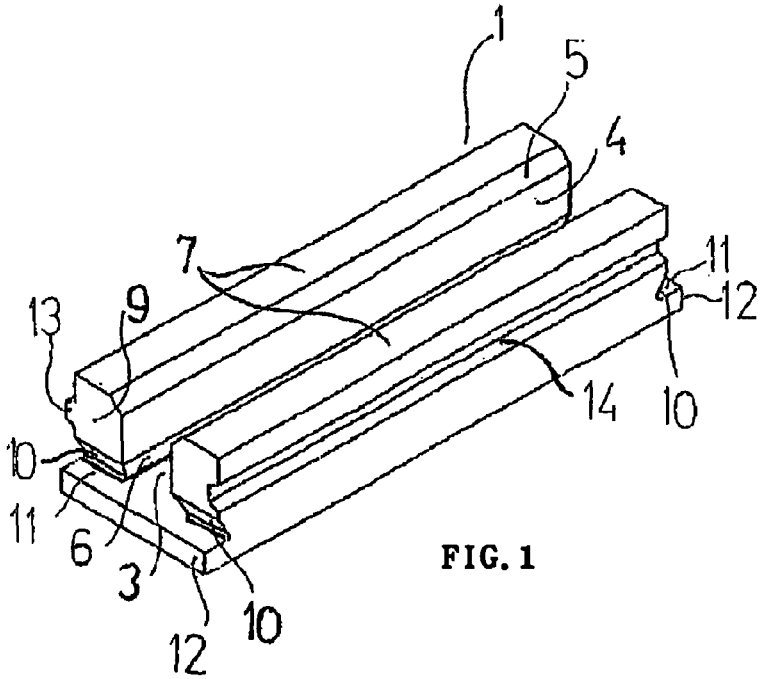
Figures 1, 2, 3:
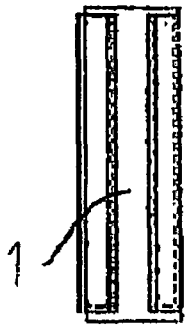
Figures 1, 2:
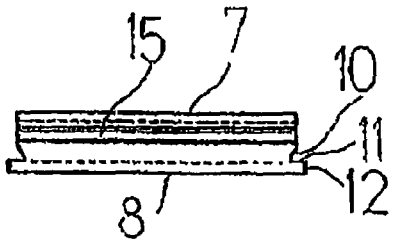
Figure 2:
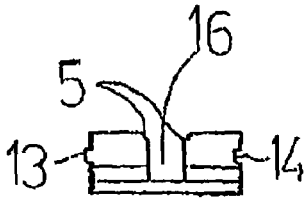
Figure 2:
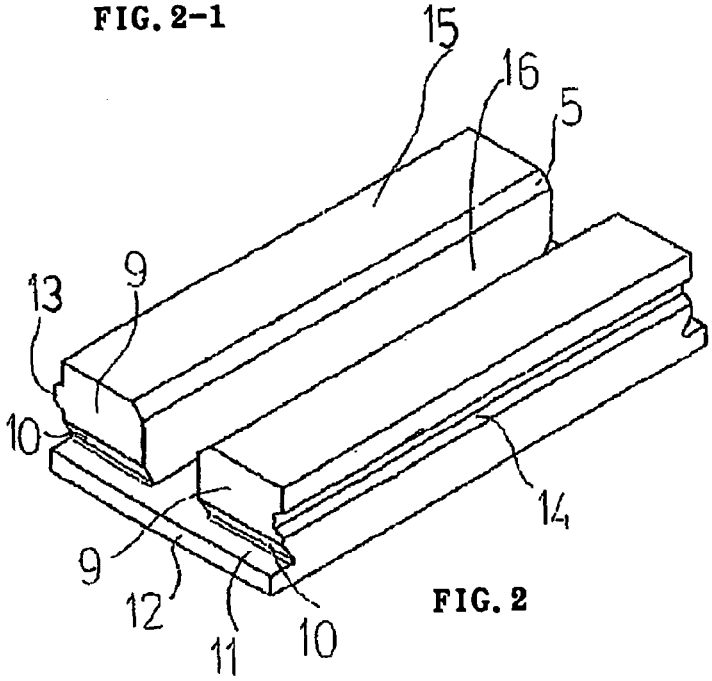
Figures 2, 3:
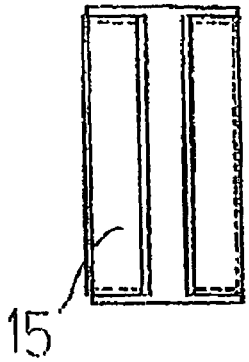
Figure 3:
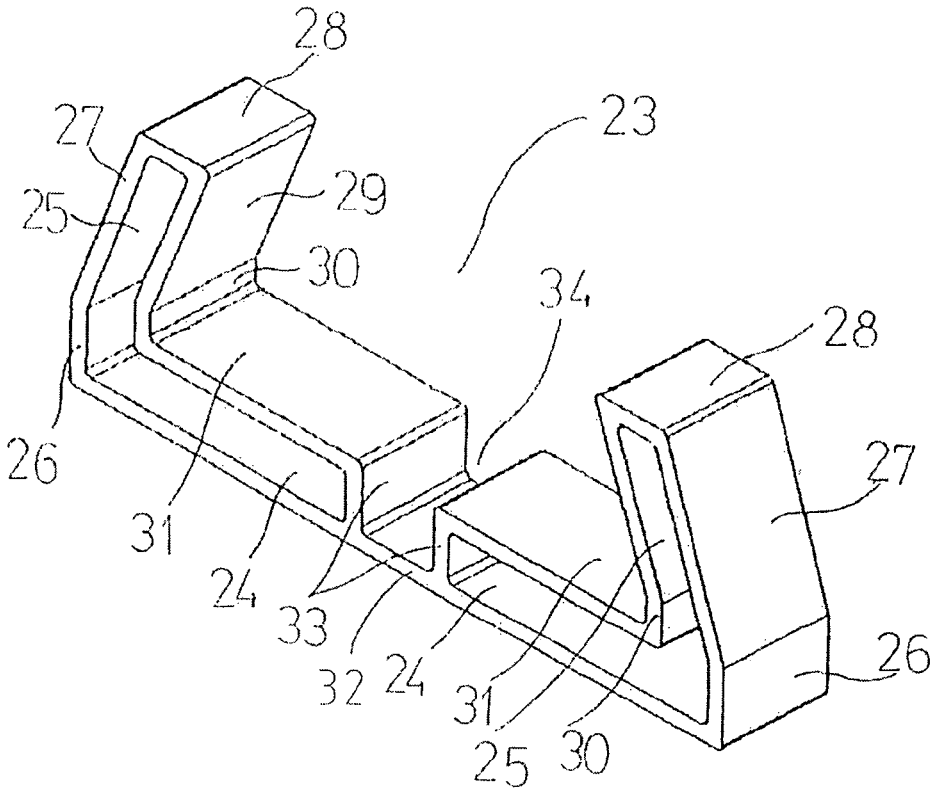
Figure 4:
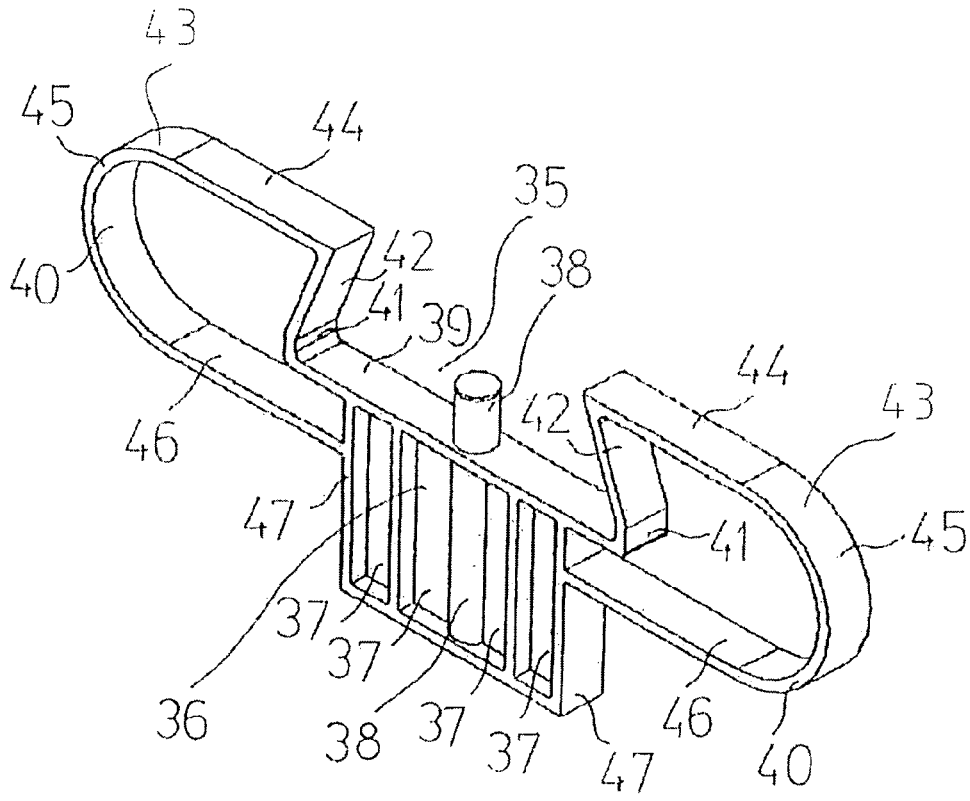
Figure 5:
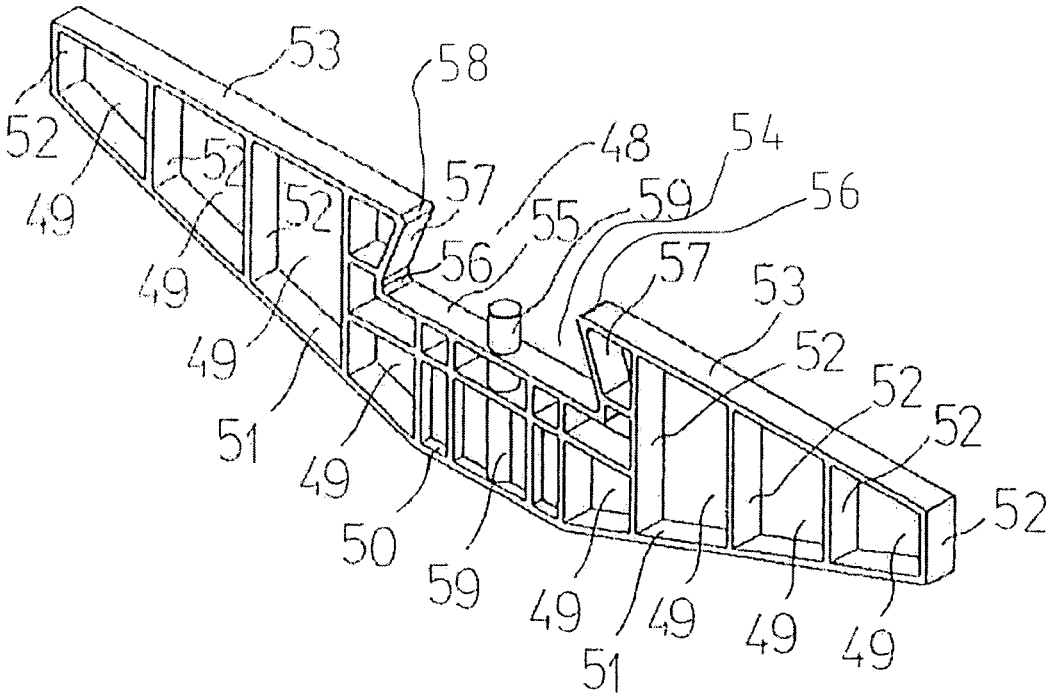
Figure 6:
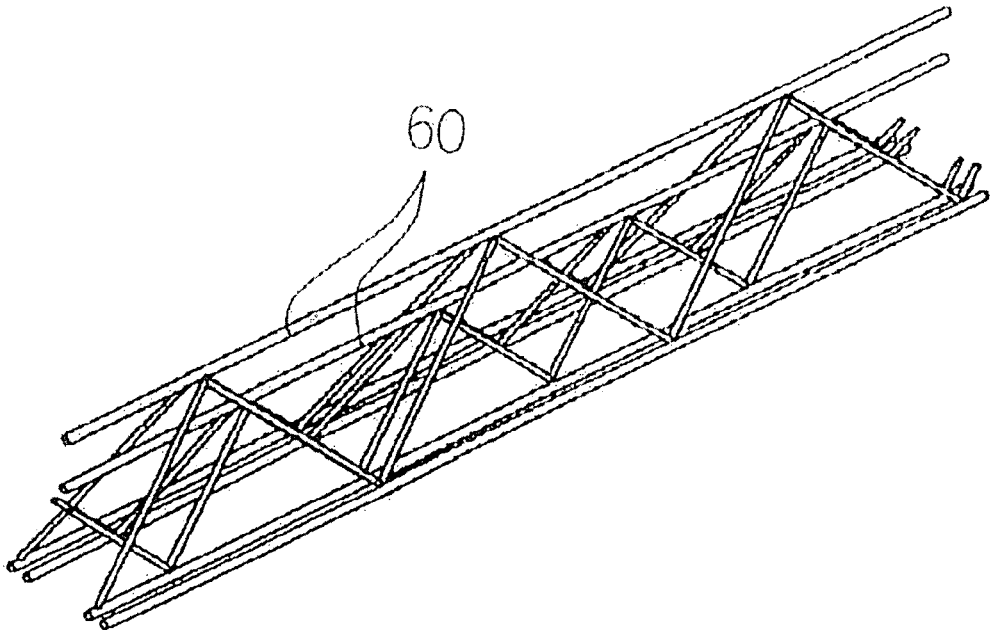
Figure 7:
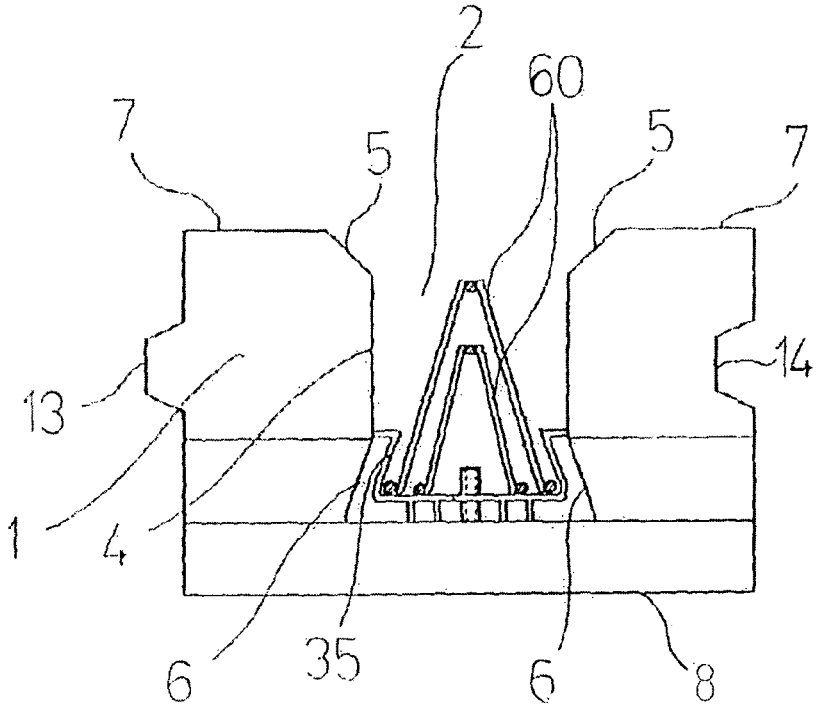
Figure 8:
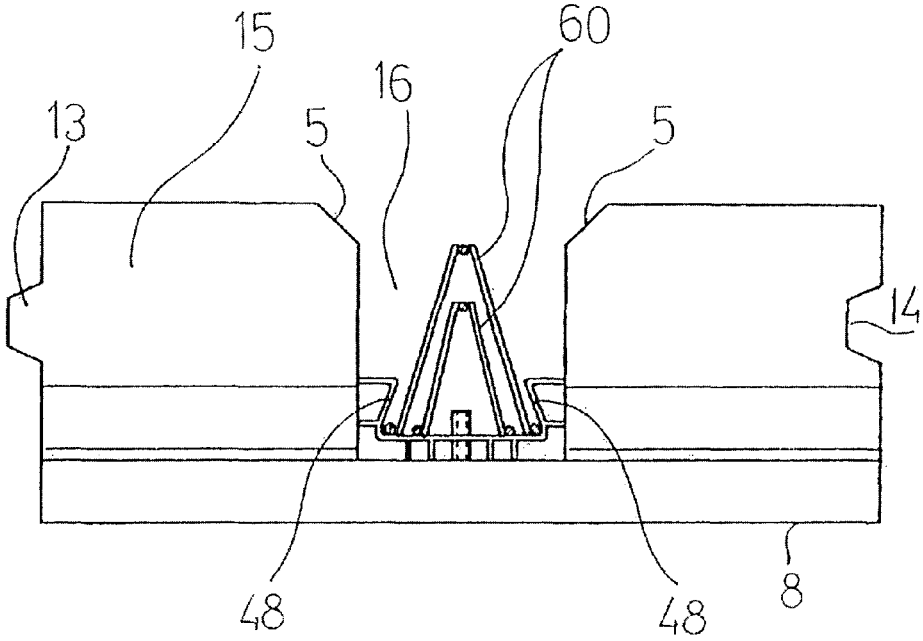
Figure 9:
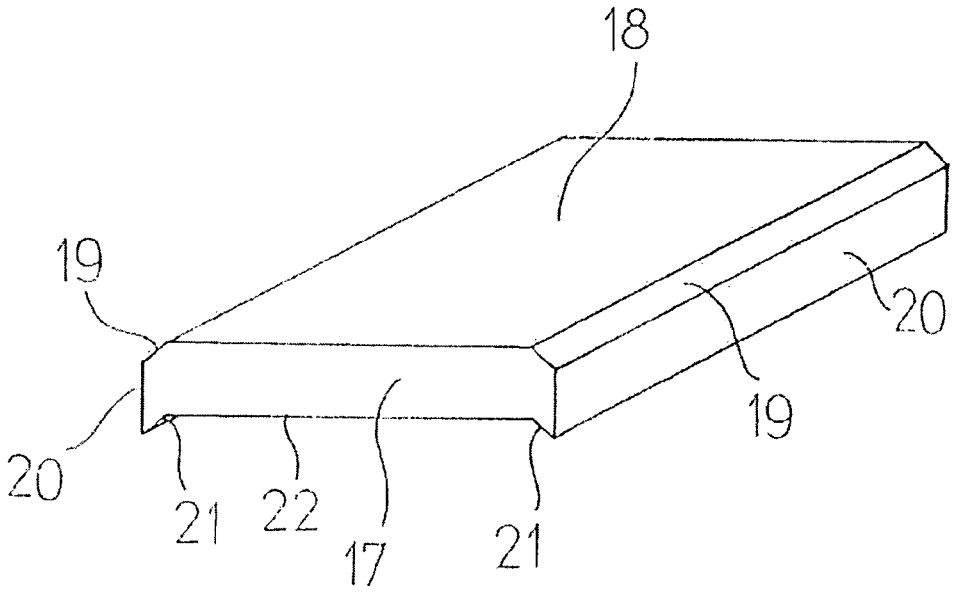

FIG. 3 is a distance element for reinforcement which are build in floor element with slope sides FIG. 4 is a distance element which are build in floor element with slope sides FIG. 5 is a distance element for reinforcement which are build in floor element with rectangle channel FIG. 6 is a space truss made from at least two lattices, which are put on distance elements of floor elements FIG. 7 is a space truss placed on the distance elements inside the channel of floor elements with slope sides FIG. 8 is a space truss placed on the distance elements inside the rectangle channel FIG. 9 is a plate floor element for increasing the height of a floor.

Figure 10:
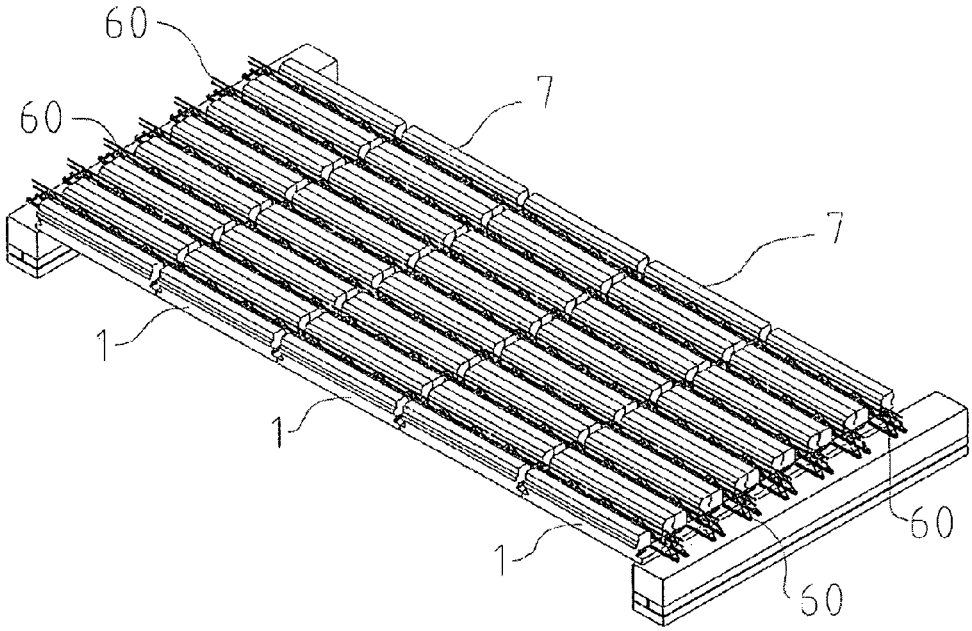

FIG. 10 is a mounted floor plate element with still space lattice

DETAIL DESCRIPTION OF THE INVENTION

This treaty is about producing specially shaped floor elements (1) from expanded polystyrene with already known technology. Floor element (1) is shaped as plate with moulding and channel (2) on the upper side of the element. Cross section of the channel (2) is consist of a trapezoid with equal flights (6) and the basic angle of 70° on the bottom side, the rectangle shaped prism with flat sides (4) on the middle, and of a trapezoid which flights (5) and the basic angle of 135°. In the aim to enabling the concrete support during the mounting one element (1) to another, the upper side (7) of the element is shorter than the lower side (8). The front and the backside of the element (1) are consisting of upper vertical (9), a slope (10), a horizontal (11) and a lower vertical (12). The lateral sides of the elements are moulded, so that one side has a convexity (13), while the other has a concavity (14), both of same dimensions and which enables the connections between prefabricated beams. Floor elements (15) are produced by same technology. The difference between elements (1) and (15) is in the shape of its channels. The cross section of the channel (16) of the element (15) is consist of rectangle on the bottom and of a trapezoid on the upper side, which is same as the upper trapezoid of the cross section of the channel (2) of the element (1). The plates (17) are produced by same technology. Those plates (17) enable the increase of the height of the floor constructions, by tying two beams in the construction. The upper side (18) of the element (17) is connected to the slope sides (19) by the angle of 45°. This slope sides are connected to the lateral sides (20), which are connected with another slope side (21) also by the angle of 45°. At last, slope sides (21) are connected to the base (22). The slope sides (19) and (21) are equal, as well as the upper side (18) and lower side (22). This enables to build several stratums of plate element (17) according to the demanded floor height. To protect the reinforcement, the distance elements (23) or (35) are built in the channel (2) of the element (1). The lateral sides (25) of the distance element (23) are built on the lower side (24). The lateral sides (25) are identical, placed one against other. Those lateral sides (25) are consist of a vertical (26), slope side (27), upper horizontal side (28) proceed with slope side (29), upper horizontal (30), middle horizontal (31), little lower slope side (32), lower vertical (33), which descents to the prism shaped inside (34) of the distance element (23). Distance element (23) is built in a produced element (1).

There is a possibility to produced floor element (1) with distance element (35), which is built in during the production. Distance element (35) has a prism base (36) with parallel chambers (37) and cylindrical tipple (38) for screw. Lateral sides (40) are symmetrically built on the upper side (39) of the distance element (35). Lateral side (40) are connected the lateral side (47) of the prism base (36) by vertical (41), slope side (42), upper slope side (43), upper horizontal (44), bucket (45) and lower horizontal (46). The steel space truss reinforcement is fixed on distance elements (35). The ceiling constructions are directly screwed on, so that prism base (36) is a couch in shorting the floor construction during mounting and concreting. Floor element (15) is produced with built-in distance elements (48). Thin walled distance element (48) with chambers (49) is consisting of lower base (50); slop sides (51), verticals (52), upper horizontals (53) and concavity (54). The inside of this concavity (54) are consist of horizontal (55), verticals (56), big slope sides (57) and small slope sides (58) that ends on upper horizontal (53). Cylindrical tipple (59) are placed in the middle of distance element (48), which can be used for screwing ceiling construction. The walls of distance element (48) are 3 mm thick.

At least one already known steel space truss are put inside the other space truss. Those steel space truss (60) are together placed inside the distance elements into the channel of polystyrene floor elements (1), or (15). Those elements (1) or (15) are filled with concrete up to 3 cm thickness. After hardening of concrete the bearing longitudinal bears are put along each other, with minimum shorting. After that the construction are concreted up to the full thickness. In the process of whole prefabrication the bears are concreted in whole thickness and than they are put on to the supports, with no shorts.

POTENTIAL APPLICATION OF THE INVENTION IN INDUSTRY OR ELSEWHERE

The invention can be completely produced in industry.

The invention claimed is:

1. A floor plate element (1) comprising an upper side and two lateral sides for special lightening, insulating and reinforcing intermediate floor constructions and enabling fast building of semi-prefabricated and prefabricated floors with complete insulation, bearing capacity and smaller price, is characterized in that the floor plate element (1) is a molded plate with a channel (2) at the upper side of the element, wherein the cross section of said channel (2) consists of:

- a trapezoid at the bottom of the channel (2), said trapezoid having equal flights (6) and an angle of 70° between each flight (6) and the bottom of the channel (2),
- a rectangle shaped prism with flat sides (4) in the middle part of the channel (2), and
- a trapezoid at the upper side of the channel (2), said trapezoid having equal flights (5) and an angle of 135° between each flight (5) and the lower side of the trapezoid, the upper side (7) of the floor plate element (1) is shorter than the lower side (8), the front and the backside of the floor plate element (1) consist in the direction from the top to the bottom of the following adjacent surfaces: an upper vertical surface (9), a sloped surface (10), a horizontal surface (11) and a lower vertical surface (12), and the lateral sides of the floor plate element (1) are molded, so that one side has a convexity (13), while the other has a concavity (14) with corresponding dimensions.

2. The floor plate element (1,15) as defined by claim 1 with a second floor plate element (17) having an upper side (18) which is connected to upper sloped sides (19) by an angle of 45° wherein the sloped sides (19) are connected to lateral sides (20), which are connected to lower sloped sides (21) by an angle of 45°, the lower sloped sides (21) are connected to the lower side (22) of the second plate element, the upper (19) and lower (21) sloped sides have the same dimensions and are parallel, and the upper side (18) and the lower side (22) are having the same width.

3. The floor plate element (1) as defined by claim 1 with a distance element (23) which is built to fit into the channel (2) of the floor plate element (1), wherein said distance element (23) comprises two identical lateral sides (25) built on a lower side (24), said lateral sides (25) consist each of a first vertical side (26), a first sloped side (27), an upper horizontal side (28) which proceeds with a second sloped side (29), a second vertical side (30), a middle horizontal side (31), a little lower sloped side (32), a lower vertical side (33), which descents to a prism shaped inside (34) of the distance element (23).

4. The floor plate element (1) as defined by claim 1 with a distance element (35) which is during the production built in the floor plate (1), wherein said distance element (35) has a prism base (36) with parallel chambers (37) and a cylindrical tipple (38) for a screw, said distance element (35) has also two lateral sides (40) which are symmetrically built on the upper side (39) of the distance element (35) and said lateral sides (40) are connected to lateral sides (40) of the prism base (36)

by vertical sides (41), sloped sides (42), upper sloped side (43), an upper horizontal (44) and a bucket (45).

5. A construction comprising floor plate elements (1,15) as defined by claim 4, with a steel space truss (60) placed inside the distance element (23,35,48) in the channel of each floor plate element (1,15) which is of polystyrene, wherein the floor plate elements (1,15) have been filled with concrete up to 3 cm thicknesses to form longitudinal bearing beams, and wherein, after hardening of said concrete, the longitudinal bearing beams have been put along each other, with a minimum of shoring and wherein the construction has been concreted up to the full thickness, or wherein during a process of whole prefabrication the floor plate elements (1,15) have been concreted over their whole thickness to form longitudinal bearing beams and wherein said longitudinal bearing beams have been put on supports, with no shores.

* * * * *